US009175916B2

(12) United States Patent
Tasyagan

(10) Patent No.: US 9,175,916 B2
(45) Date of Patent: Nov. 3, 2015

(54) TRIGGER ASSEMBLY WITH A DEVICE TO PREVENT ACCIDENTAL FIREARM DISCHARGE WHEN DROPPED

(71) Applicant: Bahtiyar Tasyagan, Izmir (TR)

(72) Inventor: Bahtiyar Tasyagan, Izmir (TR)

( * ) Notice: Subject to any disclaimer, the term of this patent is extended or adjusted under 35 U.S.C. 154(b) by 0 days.

(21) Appl. No.: 14/167,487

(22) Filed: Jan. 29, 2014

(65) Prior Publication Data

US 2014/0196341 A1 Jul. 17, 2014

Related U.S. Application Data

(63) Continuation-in-part of application No. 13/203,547, filed on Sep. 5, 2011, now abandoned.

(51) Int. Cl.

| | |
|---|---|
| ***F41A 17/46*** | (2006.01) |
| ***F41A 19/42*** | (2006.01) |
| ***F41A 17/56*** | (2006.01) |
| ***F41A 19/12*** | (2006.01) |
| ***F41A 17/48*** | (2006.01) |

(52) U.S. Cl.

CPC ..... *F41A 17/56* (2013.01); *F41A 17/46* (2013.01); *F41A 17/48* (2013.01); *F41A 19/12* (2013.01)

(58) Field of Classification Search

CPC ..... F41A 17/00; F41A 17/22; F41A 17/46; F41A 17/48; F41A 19/00; F41A 19/42; F41A 19/49

USPC ..... 42/70.04–70.06, 69.01–69.03

See application file for complete search history.

(56) References Cited

U.S. PATENT DOCUMENTS

| | | | | | |
|---|---|---|---|---|---|
| 2,571,132 | A | * | 10/1951 | Harvey | 42/69.03 |
| 3,707,796 | A | * | 1/1973 | Bielfeldt | 42/70.05 |
| 3,731,416 | A | * | 5/1973 | Semple | 42/42.01 |
| 3,903,631 | A | * | 9/1975 | Vesamaa | 42/70.01 |
| 4,310,981 | A | * | 1/1982 | Waddell | 42/42.01 |
| 2001/0054246 | A1 | * | 12/2001 | Guhring et al. | 42/69.03 |

* cited by examiner

*Primary Examiner* — Jonathan C Weber

(74) *Attorney, Agent, or Firm* — Inventa Capital PLC

(57) ABSTRACT

A trigger assembly prevents the rifle from being damaged and improves the user safety by preventing unintentional firing (rifle's falling down to the ground, hitting any place, etc.) as long as a trigger lever is not pulled by the user.

3 Claims, 3 Drawing Sheets

TRIGGER ASSEMBLY WITH A DEVICE TO PREVENT ACCIDENTAL FIREARM DISCHARGE WHEN DROPPED

RELATED APPLICATIONS

This application is a continuation in part application that claims priority to U.S. non-provisional application Ser. No. 13/203,547 filed on Sep. 5, 2011 and incorporated herewith by reference in its entirety.

FIELD OF THE INVENTION

The present invention relates generally to a trigger for a gun, which prevents the gun from being damaged and which improves the user safety more by means of preventing usage without the user demand (rifle's falling down to the ground, hitting any place, etc.).

BACKGROUND OF THE INVENTION

Weapons such as handguns, rifles, shotguns, cross-bows and others generally are activated or fired by using a trigger. The trigger generally operates with various linkages that interact with elements of the weapon causing the weapon to fire. The operation of the weapon trigger largely depends on the type of weapon. There can be a danger if someone unauthorized to operate the weapon gains access to the weapon and is able to "fire" the weapon especially if the weapon is loaded.

Devices other than weapons that have triggers could benefit from a device that would selectively fix the trigger in a fire or operation and no-fire or no-operation position. This unauthorized operator may not realize that the weapon is loaded or may not understand how to correctly and safely operate or handle the weapon. They may just be careless with the weapon and not realize at is loaded. No matter what the issues are relating to safety, another safety device or additional device likely to lessen the likelihood of accidents and unauthorized users of weapons would be welcome.

Generally hand guns and other weapons have some type of "safety" devices. These devices engage some portion of the weapon and prevent the weapon from firing when these devices are in the no-fire position. Many of these devices are well known in the prior art and consist of various manually operated levers or buttons which put the weapon selectively in the no-fire or fire positions.

The problems with some types of devices are that they can be defeated or manipulated rather easily so that the weapon can be put in the fire position without much effort or intellect. Some of these devices can arm a weapon if the lever or button is caught on clothing or bumped while the weapon is being carried or stored. While these devices may be appropriate for careful responsible adult users, these devices are not the best for curious children. User safety has a great importance in the air aiming rifles as in all of the guns those are currently present. After the rifle mechanism is set up, the rifle should not burst as a result of the falling of the rifle meaning the rifle's falling down, hitting any place, or as a result of a concussion. Otherwise, the user security cannot be provided and the rifle is damaged.

Various developments have been made for meeting the need against these types of reasons in the known art. These developments are disclosed in United States Patent Publication No. U.S. 2008 078 284, Turkish Patent Publication No. TR 2006 044 54, and PCT Application No. PCT/TR2008/000141. Many types of other devices exist and are well know in the art such as transmitter type rings and locks that clamp over the trigger and prevent operation of the tiger. While separate devices that lock the trigger can be effective, there are problems in that the devices detach from the weapon and can be misplaced or dropped in the snow or mud. It these devices come in two or more pieces that can become detached from one another, this contributes to the possibility of loss. This can be a dis-incentve to replacing the device on the weapon once removed, thus endangering unauthorized persons when the device is not replaced. Other clip or attachment type devices suffer from similar disadvantages.

Another disadvantage of the attachable type devices is that many only attach to one side of the weapon and must be oriented to the weapon to be attached property. This can make them difficult to reattach to the weapon in low light, the dark or with gloves or mittens.

Another disadvantage to these types of devices is that they must be stored somewhere when removed while the weapon is in the fire position. The storage spot will many times be the users pocket which can be bulky and uncomfortable. In bush conditions the device could possibly fall out and become lost. The user could also put the device down once removed, and this raises the possibility of forgetting it if they were to leave in a hurry. There are weight issues too that can arise for one who is hiking or hunting and needs to carry gear that is of minimal weight.

In view of the disadvantages to the devices known in the art there is a need for a device that stays affixed to the weapon, is of light weight, is relatively easy to operate and yet provides protection from unauthorized users. For the foregoing reasons, there is a need for a trigger lock device that deters the operation of a trigger on a weapon or device by unauthorized users.

SUMMARY OF THE INVENTION

A trigger assembly of the present invention is used for preventing accidental gun discharge. The trigger assembly includes a hammer, which enables to fire a gun, a first sear element interconnected with the hammer by a first spring element. A second sear element allows the first sear element to move in a second direction. A lock element presenting a plate that defines a first opening to receive a first end of a second spring and a second opening to receive a pin wherein the second spring is connected to the lock element to overcome the energy of the first sear element to apply pressure to a trigger to lock the trigger thereby preventing the second sear element from moving in a third direction (C) as the second sear element is prevented from moving as the hammer and the first sear element are prevented from moving in the first direction (A) and the second direction (B) thereby preventing any accidental firing of the gun.

A first object of the invention is to provide a device that can selectively position a weapon trigger in the fire and no-fire positions.

Another object of the invention is to provide a device that requires a key to position the weapon trigger in the fire and no-fire positions.

Still another object of the invention to provide a device that is aesthetically appealing and does not deter from the weapon profile.

Still another object of the invention to provide a device that is relatively inexpensive and easy to manufacture.

Still another object of the invention is to provide a device that is relatively easy to place in the no-fire position and requires a positive action to put the weapon in the fire position.

Still another object of this invention is to achieve a trigger which provides more user security by means of preventing the rifle from doing firing without user demand via the lock and the spring in itself.

Still another object of the invention is to achieve a trigger which does not allow the rifle to be damaged by means of preventing the rifle from doing firing without user demand via the lock and the spring in itself.

These together with other objects of this invention, along with various features of novelty which characterize this invention, are pointed out with particularity in the claims annexed hereto and forming a pan of this disclosure. For a better understanding of this invention, its operating advantages and the specific objects attained by its uses, references should be had to the accompanying drawings and descriptive matter in which there is illustrated a preferred embodiment of this version of the invention.

Other advantages and meritorious features of this invention will be more fully understood from the following description of the preferred embodiment, the appended claims, and the drawings; a brief description of which follows.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
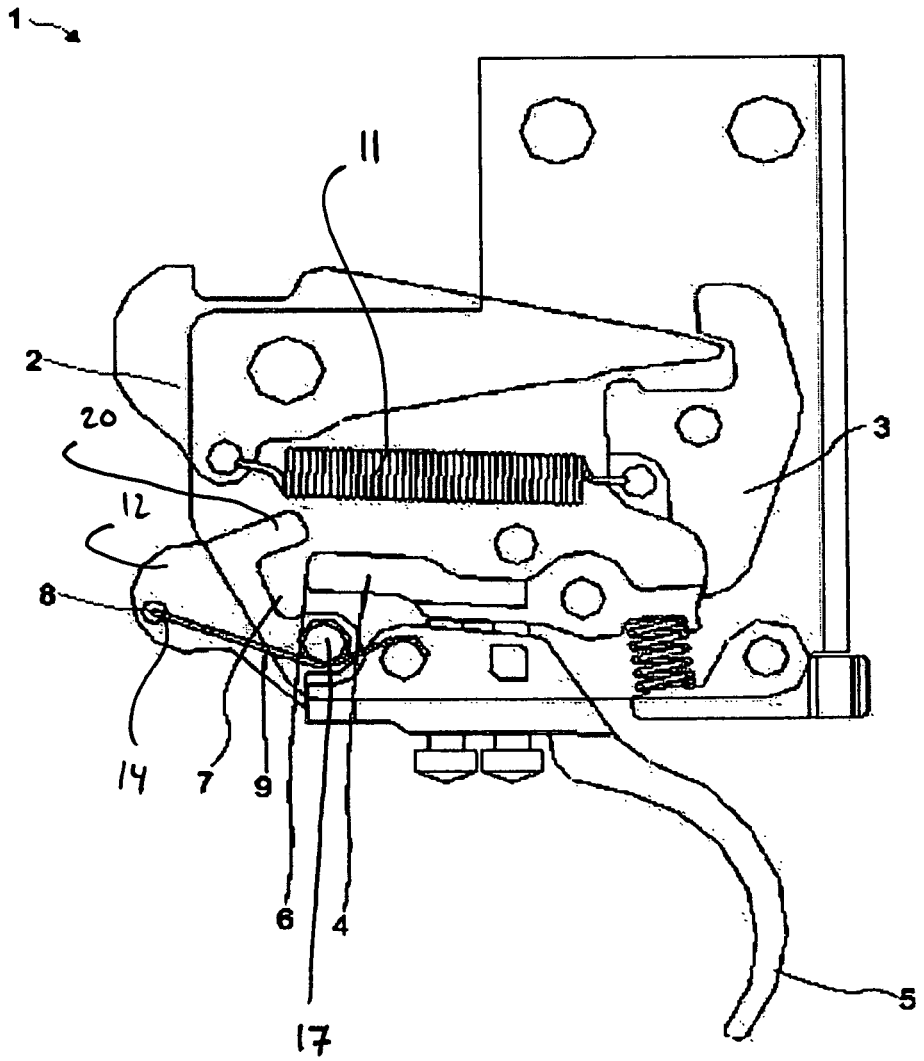
FIG. 1 illustrates a view of the position after the trigger is set up before firing.
Figure 2:
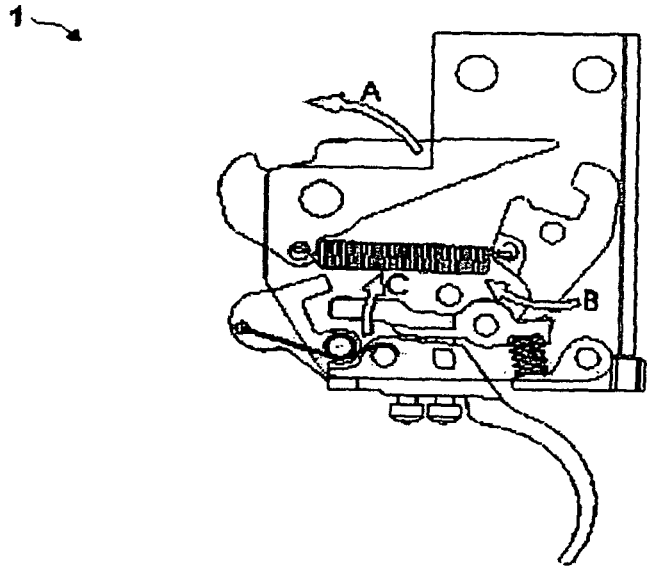
FIG. 2 is view showing the positions of the trigger after the firing is made.
Figure 3:
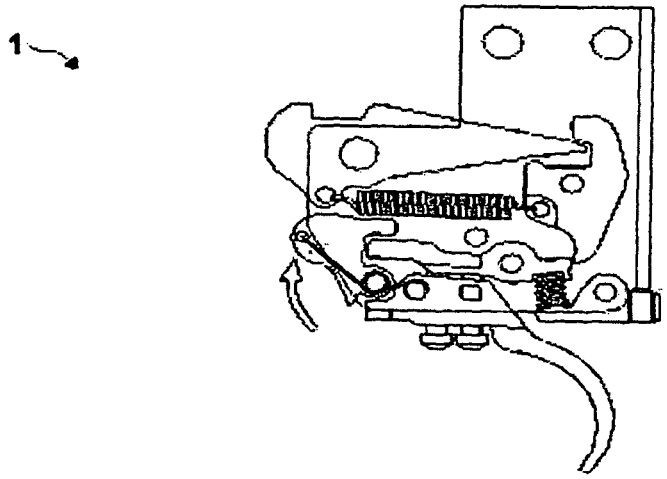
FIG. 3 is view of the position of the trigger occurring as a result of the gun's being fallen or hit.
Figure 4:
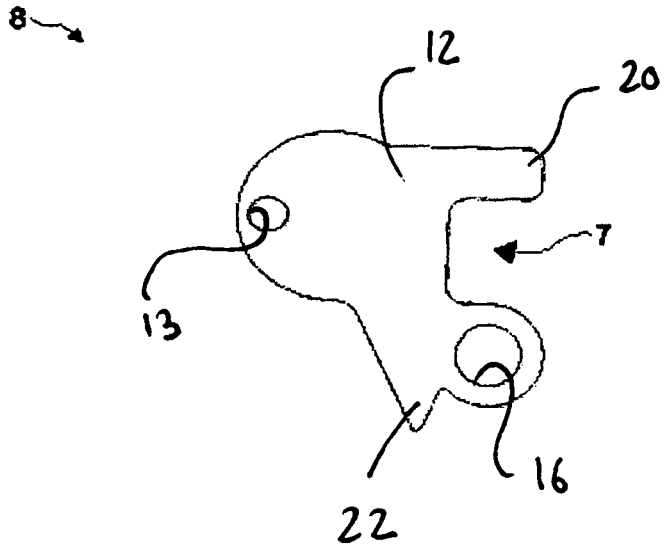
FIG. 4 is view of the lock of the trigger.
Figure 5:
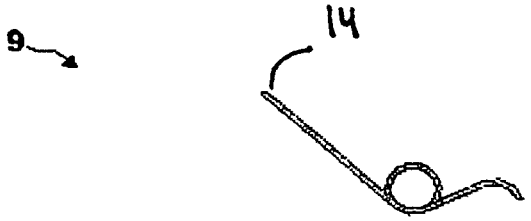
FIG. 5 is view of the lock spring of the trigger.

Referring to the Figures, wherein like numerals indicate like or corresponding parts throughout the several views, a trigger assembly (the assembly) of the present invention is generally shown at (1) in FIGS. 1 through 3.

The trigger assembly (1) of the present invention is used for preventing accidental gun discharge. The trigger assembly (1) includes a hammer (2) which enables to fire a gun. The first sear element (3) is interconnected with the hammer (2) by a first spring element (11). A second sear element (4) allows the first sear element (3) to move in a second direction (B), as best shown in FIG. 2. The second sear element (4) includes a bulge (6). A lock element (8) of the trigger assembly (1) presents a plate (12) that defines a first opening (13) to receive a first end (14) of a second spring (9) formed from a wire. The plate (12) includes a second opening (16) to receive a pin (17).

The second spring (9) is connected to the lock element (8) to overcome the energy of the first sear element (3) to apply pressure to a trigger (5) to lock the trigger (5) thereby preventing the second sear element (4) from moving in a third direction (C), as shown in FIG. 2. The second sear element (4) is prevented from moving as the hammer (2) and the first sear element (3) are prevented from moving in the first direction (A) and the second direction (B) thereby preventing any accidental firing of the gun.

The lock element (8) includes a cut out portion (7) of a generally rectangular configuration defined between a finger (20) extending from the plate (12) and the second opening (16). The cut out portion (7) is used to mechanically engage the bulge (6) of the second seal element (4) when the lock element (8) is in a locking position thereby preventing movement of the second sear element (4). A stopper (22) extends from the plate (12) to control movement of the lock element (8) rotatable about the pin (17).

The second sear element (4) allows the first sear element (3) to rotate in a second direction (shown at B in FIG. 2) by virtue of propulsion through the first sear element (3). The second spring (9) is connected to the lock element (8) in order to overcome the energy of the first sear element (3) by means of applying pressure to the trigger (5). The trigger (5) is locked thereby preventing the second sear element (4) from rotating in a third direction (shown at C in FIG. 3) by overcoming the spring (9) connected to the lock element (8) as the gun falls down. Since the second sear element (4) cannot rotate or move, the other first sear element (3) and the hammer (2) are prevented from rotation in the first direction (A) and the second direction (B), thereby preventing any accidental firing of the gun.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A trigger assembly (1) for preventing accidental gun discharge, said trigger assembly (1) comprising:

a hammer (2) to fire a gun;

a first sear element (3) interconnected with said hammer (2) by a first spring element (11);

a second sear element (4) that allows said first sear element (3) to move in a second direction (B), said second sear element (4) includes a bulge (6); and a lock element (8) presenting a plate (12) that defines a first opening (13) to receive a first end (14) of a second spring (9) and a second opening (16) to receive a pin (17) wherein said second spring (9) is connected to said lock element (8) to lock a trigger (5) thereby preventing said second sear element (4) from moving in a third direction (C) thereby preventing accidental firing of the gun.

2. A trigger assembly (1) as set forth in claim 1, wherein said lock element (8) includes a cut out portion (7) of a generally rectangular configuration defined between a finger (20) extending from said plate (12) and said second opening (16), said cut out portion (7) is used to mechanically engage said bulge (6) of said second sear element (4) when said lock element (8) is in a locking position thereby preventing movement of said second sear element (4).

3. A trigger assembly (1) as set forth in claim 1, wherein said lock element (8) includes a stopper (22) extending from said plate (12) to control movement of said lock element (8) rotatable about said pin (17).

* * * * *